US006021749A

United States Patent [19]

Gaisberg

[11] Patent Number: 6,021,749

[45] Date of Patent: Feb. 8, 2000

[54] ARRANGEMENT FOR ACTUATING A CHARGE CYCLE VALVE HAVING AN ELECTROMAGNETIC ACTUATOR

[75] Inventor: Alexander von Gaisberg, Fellbach, Germany

[73] Assignee: DaimlerChrysler AG, Stuttgart, Germany

[21] Appl. No.: 09/094,673

[22] Filed: Jun. 15, 1998

[30] Foreign Application Priority Data

Jun. 13, 1997 [DE] Germany ..... 197 25 010

[51] Int. Cl.[7] ..... F01L 9/04

[52] U.S. Cl. ..... 123/90.11; 251/129.16

[58] Field of Search ..... 123/90.11; 251/129.01, 251/129.1, 129.15, 129.16

[56] References Cited

U.S. PATENT DOCUMENTS

| | | | |
|---|---|---|---|
| 4,715,332 | 12/1987 | Kreuter | 123/90.11 |
| 4,831,973 | 5/1989 | Richeson, Jr. | 123/90.11 |
| 4,878,464 | 11/1989 | Richeson, Jr. et al. | 123/90.11 |
| 4,972,810 | 11/1990 | Kawamura | 123/90.11 |
| 5,199,392 | 4/1993 | Kreuter et al. | 123/90.11 |
| 5,269,269 | 12/1993 | Kreuter | 123/90.11 |
| 5,720,242 | 2/1998 | Izuo | 123/90.11 |

FOREIGN PATENT DOCUMENTS

| | | |
|---|---|---|
| 197 07 810 | 5/1998 | Germany . |
| 117 045 | 10/1926 | Switzerland . |
| 2319301 | 5/1998 | United Kingdom . |

*Primary Examiner*—Weilun Lo
*Attorney, Agent, or Firm*—Evenson, McKeown, Edwards & Lenahan, PLLC

[57] ABSTRACT

An arrangement is provided for actuating a charge cycle valve having an electromagnetic actuator which has an opening magnet and a closing magnet between which an armature is arranged in a coaxially displaceable manner which acts upon a valve stem. A spring acts upon the valve stem and is arranged between an upper driving element facing away from the charge cycle valve and a lower driving element facing the charge cycle valve. The driving elements are connected for joint movement with the armature. The spring is displaceable between an upper path boundary and a lower path boundary and is supported in the open position of the charge cycle valve in the upward direction on the upper driving element and in the downward direction on the lower path boundary. In the closing position of the charge cycle valve, the spring is supported in the upward direction on the upper path boundary and in the downward direction on the lower driving element. In the case of an approximately central position of the armature between the opening magnet and the closing magnet, one driving element respectively lifts the spring off the corresponding path boundaries. The armature has an armature tappet which is connected by way of a connection element with the valve stem.

19 Claims, 4 Drawing Sheets

ARRANGEMENT FOR ACTUATING A CHARGE CYCLE VALVE HAVING AN ELECTROMAGNETIC ACTUATOR

BACKGROUND AND SUMMARY OF THE INVENTION

This application claims the priority of German Application No. 197 25 010.6, filed Jun. 13, 1997, the disclosure of which is expressly incorporated by reference herein.

The invention relates to an arrangement having an electromagnetic actuator for actuating a charge cycle valve.

Electromagnetic actuators for actuating charge cycle valves of an internal-combustion engine, as a rule, have two switching magnets—an opening magnet and a closing magnet—between whose pole faces an armature is arranged so that it can be displaced coaxially with respect to a valve shaft of the charge cycle valve. The armature acts directly or by way of a tappet upon a valve stem of the charge cycle valve. In the case of actuators according to the principle of a mass oscillator, a prestressed spring mechanism with two prestressed pressure springs acts upon the armature or the armature tappet, specifically an upper and a lower valve spring. If both valve springs are arranged below the actuator, as a rule, the upper valve spring is supported in the direction of the actuator on the opening magnet and is supported in the direction of the charge cycle valve on a spring plate fixedly connected with the armature tappet, and acts in the opening direction of the charge cycle valve. The lower valve spring is supported in the direction of the charge cycle valve on a cylinder head and is supported in the direction of the actuator on a second spring plate fixedly connected with the valve stem, and acts in the closing direction of the charge cycle valve. When the magnet is not energized, the armature is held in a condition of equilibrium between the magnets by means of the valve springs.

When the actuator is operated, the closing magnet or the opening magnet is overexcited for a short time or the armature is caused to carry out oscillations by means of a stimulating routine in order to attract it out of the condition of equilibrium. In the closed position of the charge cycle valve, the armature will rest against the pole face of the energized closing magnet and is held by it. The closing magnet prestresses the valve spring acting in the opening direction. In order to open the charge cycle valve, the closing magnet is switched off and the opening magnet is switched on. The valve spring acting in the opening direction accelerates the armature beyond the condition of equilibrium so that it is attracted by the opening magnet. The armature strikes against the pole face of the opening magnet and is held by it. In order to close the charge cycle valve again, the opening magnet is switched off and the closing magnet is switched on. The valve spring operating in the closing direction accelerates the armature beyond the condition of equilibrium to the closing magnet. The armature is attracted by the closing magnet, strikes on the pole face of the closing magnet, and is held by it.

From an older application—German Patent Document DE 197 07 810.9 (corresponding to U.S. Ser. No. 09/031,741, filed Feb. 27, 1998, and commonly owned by the assignee of the present invention, the specification of which is expressly incorporated by reference herein) a spring mechanism is known which has only one spring. The spring is arranged in a prestressed manner on the valve stem below the opening magnet between an upper driving element facing away from the charge cycle valve and a lower driving element facing the charge cycle valve. A spring plate is arranged in each case between the driving element and the spring, which spring plates are guided coaxially displaceably with respect to one another on the driving elements. During the closing and opening of the charge cycle valve, the spring is moved between an upper and a lower path boundary. In the case of an approximately central position, the spring is supported on the two path boundaries. When the charge cycle valve is opened from the central position, the lower driving element dips into the lower path boundary. The spring is then supported in the downward direction by way of the lower spring plate on the lower path boundary and is supported in the upward direction by way of the upper spring plate on the upper driving element, by which it is prestressed further. When the charge cycle valve is closed from the central position, the upper driving element dips into the upper path boundary, the spring is supported by way of the upper spring plate on the upper path boundary and is supported by means of the lower spring plate on the lower driving element, which prestresses the spring.

If the same distance exists between the driving elements as between the path boundaries, an arrangement is achieved which has no play and in which the central position of the armature is determined precisely by the spacing, independently of a spring rate. In addition, the expenditures of the spring system are reduced in that only one spring is required which, because of a lower required prestressing, can be dimensioned to be weaker and smaller. Specifically, the described spring deflection system is particularly short because only one spring is required which, in addition, is prestressed further by the driving elements only by half the lift course of the charge cycle valve.

The described advantages of the spring deflection system contrast with a relatively high-expenditure mounting, during which first the valve stem must be inserted from below into the cylinder head and subsequently the parts of the actuator must individually be pushed onto the valve stem and then be positioned and fastened, such as the lower driving element, the lower spring plate, the spring, the upper spring plate, the upper driving element, the closing magnet and the armature.

It is an object of the present invention to permit a simple mounting, while simultaneously improving the operation of the actuator.

According to the present invention, this object is achieved by an arrangement for actuating a charge cycle valve having an electromagnetic actuator which has an opening magnet and a closing magnet between which an armature is arranged in a coaxially displaceable manner. The armature acts upon a valve stem. A spring acts upon the valve stem and is arranged between an upper driving element facing away from the charge cycle valve and a lower driving element facing the charge cycle valve. The elements are connected for the joint movement with the armature. The spring is displaceable between an upper path boundary and a lower path boundary and is supported in the opening position of the charge cycle valve in the upward direction on the upper driving element and in the downward direction on the lower path boundary, in the closing position of the charge cycle valve the spring is supported in the upward direction on the upper path boundary and in the downward direction on the lower driving element. The armature has an armature tappet which is connected by way of a connection element with the valve stem.

The invention is based on the recognition that a mounting of the component parts of the actuator directly on a cylinder head, that is, the individual pushing-on, positioning and fastening of the parts on a valve stem already inserted in the cylinder head is difficult and is associated with high expenditures, particularly because of the narrow space conditions which exist. It is advantageous for the actuator to be preassembled separately in sufficient space and to be mounted on the cylinder head in the preassembled condition. This is permitted by means of the actuator according to the present invention whose armature has an armature tappet which is separate from the valve stem. The armature tappet is connected with the valve stem by way of a connection element, for example, by means of a clamped, screwed, welded or other suitable form-locking, force-locking or substance-locking connection.

In addition to being mounted in a favorable manner, the preassembled actuator can be tested separately before the installation on the cylinder head. The central position is determined by the position of the driving elements and of the path boundaries. It does not depend on a spring rate and thus, particularly, also not on a second lower valve spring which, in the case of known actuators, would not be preassembled and would therefore have to be simulated in the case of a preliminary test. As a result, fault sources, such as deviating spring rates of the lower valve spring, cannot be taken into account during the test. Tolerances caused by a second valve spring are avoided.

In this context, it is particularly advantageous for both driving elements to be fastened on the armature tappet. The spring is arranged on the armature tappet so that it cannot be lost and the positions of the driving elements can be tested beforehand.

In a further development of the invention, both path boundaries are fixedly connected with the actuator or are formed by it, whereby these can also be preassembled. If, in addition, the connection element is preassembled on the armature tappet, all component parts of the actuator are now defined beforehand and can be tested with respect to their position and operation. Faults can be recognized early and at low cost, and the consequences of faults can be limited to a minimum.

Additional details of the invention as well as resulting advantages are indicated in the following description of embodiments.

In the description and in the claims numerous characteristics are illustrated and described within the context. A person skilled in the art will expediently also consider the characteristics separately and assemble them to form additional suitable combinations.

Other objects, advantages and novel features of the present invention will become apparent from the following detailed description of the invention when considered in conjunction with the accompanying drawings.

DETAILED DESCRIPTION OF THE DRAWINGS

Figure 1:
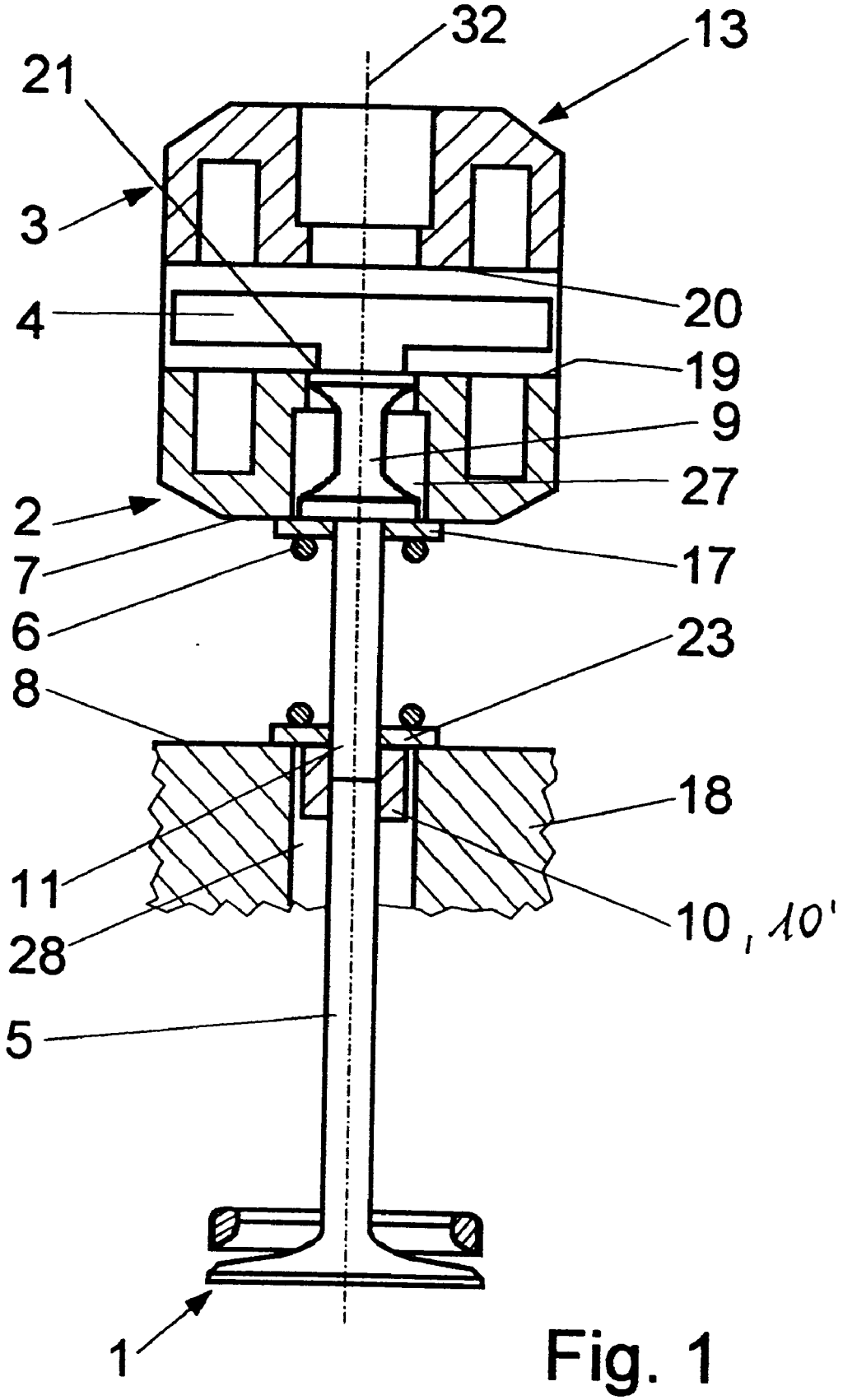
FIG. 1 is a schematic diagram of an actuator with a charge cycle valve in the central position.

FIG. 1 illustrates an actuator 13 for operating a charge cycle valve 1 inserted in a cylinder head 18. The actuator 13 is disposed in a component 14 (FIG. 4), in an actuator support or in the cylinder head 18 (FIG. 3) and has an opening magnet 2 and a closing magnet 3 between whose pole faces 19, 20, an armature 4 is arranged so that it can be displaced coaxially with respect to a valve axis 32. The armature 4 has an armature tappet 11, with which it is constructed in one piece or with which it is connected by means of a screwed connection, a clamped connection, a welded connection or another suitable form-locking, force-locking or substance-locking connection. An element 10, which is simultaneously constructed as a connection element and as a driving element, connects the armature tappet 11 by means of a clamped connection, a screwed connection or another suitable form-locking, force-locking or substance-locking connection, or a possible combination thereof, with a valve stem 5 in the tension and pressure direction.

If the connection element 10 can compensate an offset between the armature tappet 11 and the valve stem 5 in that it is, for example, constructed in an articulated or elastic manner, the armature tappet 11 and the valve stem 5 can be disposed or guided separately; for example, the armature tappet 11 in the actuator 13 and the valve stem 5 in the cylinder head 18. If an offset cannot be compensated, preferably only the armature tappet 11 or the valve stem 5 is guided so that no warping can occur because of an overrigid bearing.

Figure 2:
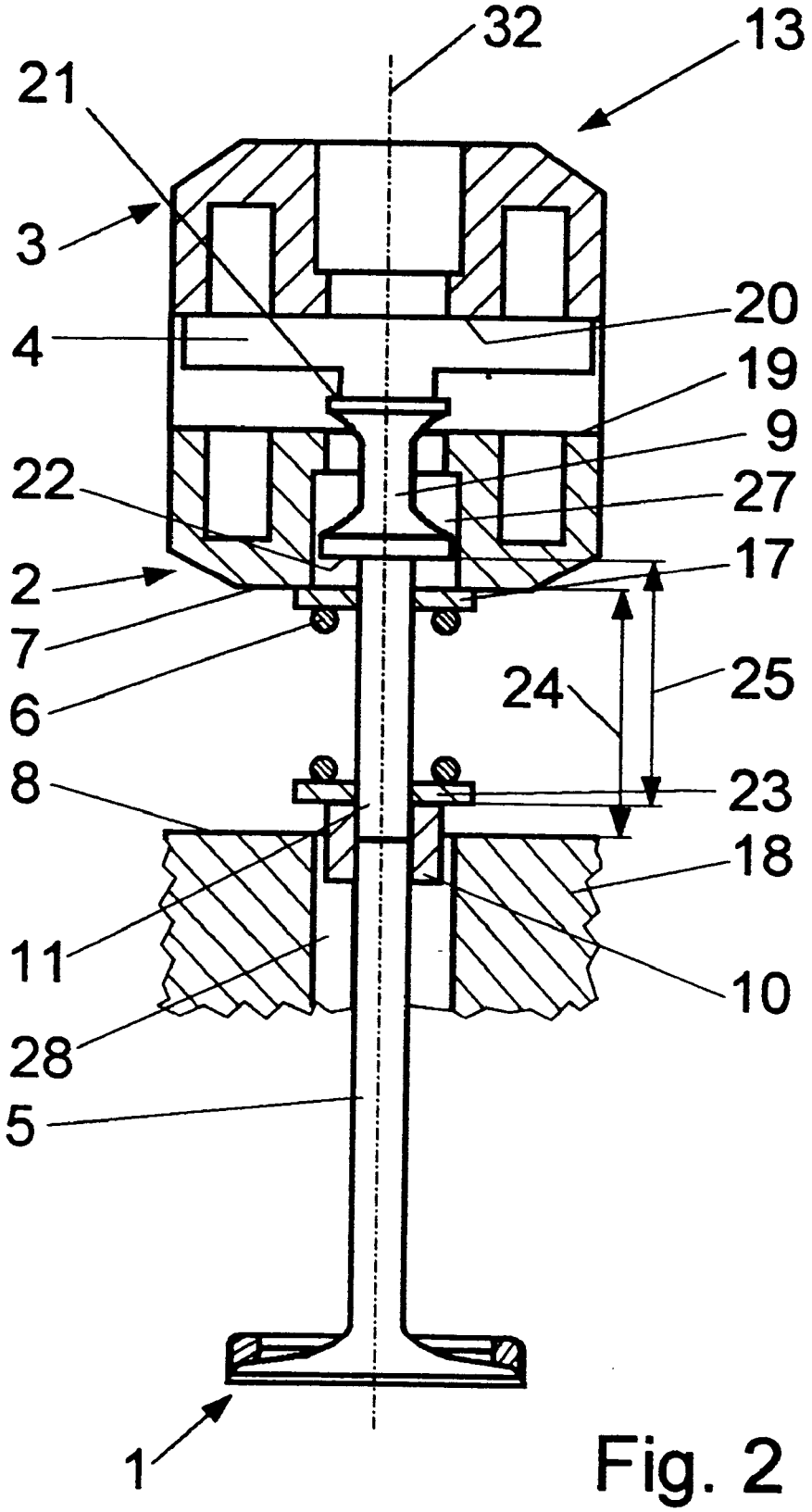
FIG. 2 is a schematic diagram of an actuator with a charge cycle valve in the closed position.

In addition to the opening magnet 2, the closing magnet 3 and the armature 4 with its armature tappet 11, the actuator 13 has a spring system which accelerates the armature 4, the armature tappet 11 and the charge cycle valve 1 from an open position by way of a central position to a closed position and inversely. The spring system has a spring 6, preferably a coil spring, which is arranged coaxially with respect to the valve axis 32 and which surrounds the armature tappet 11. The spring 6 is clamped in between an upper driving element 9 and a lower driving element 10 with a slight prestress. The upper driving element 9 can be fastened on the armature tappet 11 by means of a suitable connection; for example, by means of a screwed connection, a clamped connection, etc. However, according to the invention, the upper driving element 9 is constructed in one piece with the armature tappet 11, whereby the number of components is reduced and the mounting is simplified. In the illustrated embodiment, the upper driving element is constructed as a double cone and has a smaller upper contact surface 21 for the armature 4 and a larger lower stop surface 22 for the spring 6 (FIG. 2). The driving element 9 tapers between the stop surfaces 21, 22 in order to save moving mass.

The lower driving element 10 can be fastened on the valve shaft 5 or on the armature tappet 11. In the illustrated embodiment, it is at least partially fastened on the armature tappet 11, whereby it can be preassembled jointly with the switching magnets 2, 3, the spring, etc. The spring 6 is thereby fixed in the preassembled subassembly so that it cannot be lost. In addition, the position of the driving elements 9, 10 and the prestressing of the spring 6 are defined beforehand and can be tested in the preassembled subassembly.

In the illustrated embodiment, the lower driving element 10 is arranged above the connection point between the armature tappet 11 and the valve stem 5, whereby it can simultaneously take over the function of the connection element 10 or can be constructed in one piece with it in that it connects, for example, the armature tappet 11 and the valve stem 5 by means of a slip joint. This saves components and reduces the mounting expenditures and the moving masses. However, the connection element 10 and the driving element 10 can also consist of two parts.

Figure 3:
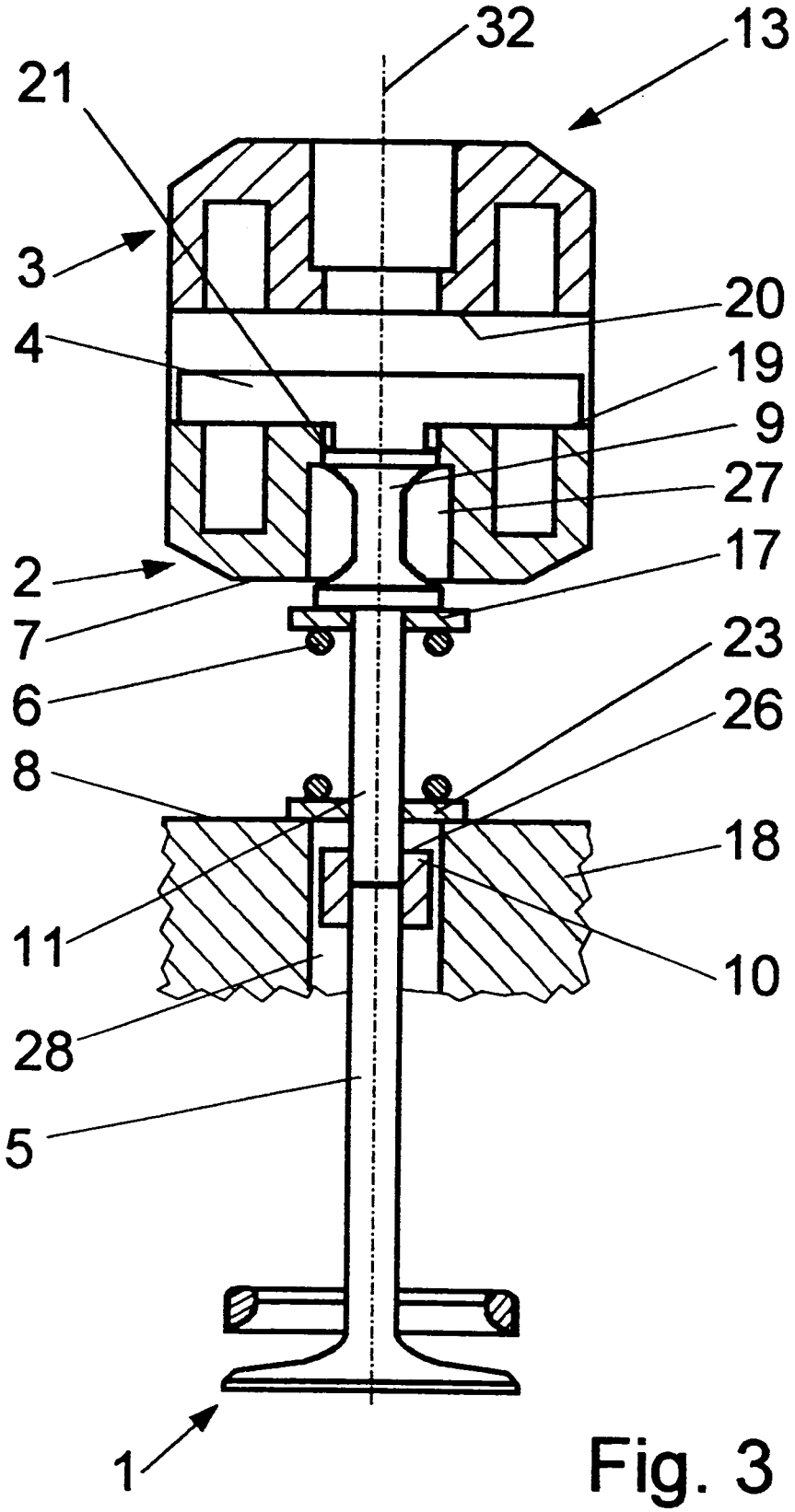
FIG. 3 is a schematic diagram of an actuator with a charge cycle valve in the open position.

The armature tappet 11 moves by means of the spring 6 clamped in between the two driving elements 9, 10 between an upper path boundary 7 and a lower path boundary 8, whose spacing 24 (FIG. 2) preferably corresponds to a distance 25 between the two stop surfaces 22, 26 of the driving elements 9, 10, whereby a central position of the armature 4 between the opening magnet 2 and the closing magnet 3 is clearly defined without play. When the armature 4 is in the geometrical central position between the switching magnets 2, 3, the stop surfaces 22, 26 (FIGS. 2 and 3) of the driving elements 9, 10 are in each case situated in a plane with the path boundaries 7, 8 (FIG. 1). If the charge cycle valve 1 is closed from the central position, the two driving elements 9, 10 move upwards into the direction facing away from the charge cycle valve 1. In the process, the upper driving element 9 detaches from the spring 6 in the upward direction and dips into a recess 27 of the upper path boundary 7. The spring 6 is supported in the upward direction on the upper path boundary 7. From below, the spring 6 is lifted by the lower driving element 10 off the lower path boundary 8 and is prestressed further (FIG. 2). If the charge cycle valve opens from the central position in FIG. 1, the two driving elements 9, 10 move downward in the direction of the charge cycle valve 1. The lower driving element 10 dips into a recess 28 of the lower path boundary 8 and the spring 8 is supported in the downward direction on the lower path boundary 8. The upper driving element 9 lifts the spring 6 off the upper path boundary 7 and further prestresses the spring 6 (FIG. 3). In the open position in FIG. 3 and in the closed position in FIG. 2, the spring 6 is in each case prestressed more and can therefore, during the subsequent closing operation or opening operation, accelerate the armature 4 beyond the central position between the pole faces 19, 20 to the opposite pole face 19 or 20 by which the armature 4 is attracted and subsequently held.

Figure 5:
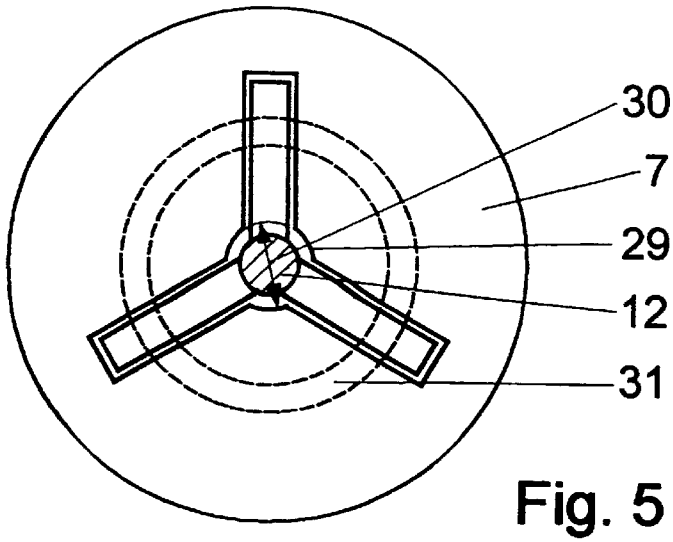
FIG. 5 is a sectional view of another embodiment of a driving element in the direction of a valve axis toward the actuator.

The recesses 27, 28 in the path boundaries 7, 8 must be constructed such that the driving elements 9, 10 can dip into them but the spring 6 can be supported on them. This can preferably be achieved by means of two mutually coaxially displaceable spring plates 17, 23 by way of which the spring 6 can be supported on the path boundaries 7, 8 or on the driving elements 9, 10. The spring plates 17, 23 themselves can be guided on the driving elements 9, 10 or directly on the armature tappet 11, whereby moving masses can again be saved. The spring plates 17, 23 have guides, which are not shown, for the spring 6, for example, a web in the direction of the spring 6 on the outer circumference. In addition, the spring plates 17, 23, particularly in the case of path boundaries 7, 8 made of softer materials, prevent the spring 6 from working itself into the path boundaries 7, 8. However, the spring plates 17, 23 represent moving masses so that the actuator 13 can advantageously be constructed without spring plates 17, 23. In an embodiment illustrated in FIG. 5 this is, for example, achieved in that the recesses 29 have a type of star-shaped contour whose inside diameter 30 is smaller than the diameter of the spring 6 which can then be supported directly on the path boundaries 7, 8, for example, in molded-on guides or grooves 31. The driving elements 12 have an outer contour which is shaped corresponding to the recess 29 and by means of it can dip directly into the recesses 29 and take the spring 6 along when emerging from the recesses 29 and prestress it. In order to avoid a working-in of the spring 6, sheet metal plates of a harder material can be fastened on the path boundaries 7, 8.

Figure 4:
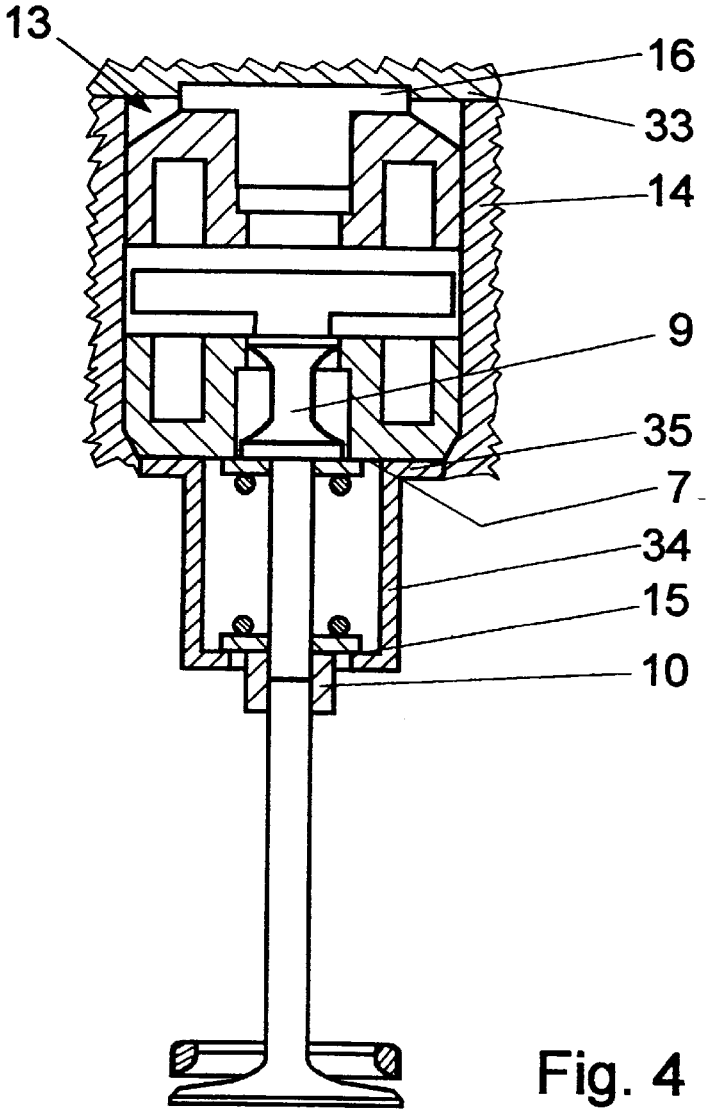
FIG. 4 is a schematic view of an actuator arranged in a floating manner.

The path boundaries 7, 8 may be formed by separate components fixed to the housing or fixed to the cylinder head or, as illustrated, by the cylinder head 18 and the actuator 13 itself, whereby additional components are saved. So that the positions of the path boundaries 7, 8 and 15 can be defined and tested already in the assembled condition of the actuator 13, both path boundaries 7, 15 are fixedly connected with the actuator 13 or formed by it (FIG. 4). The lower path boundary 15 in FIG. 4 has a pot-shaped construction or has web-type fastening arms 34 which are fastened by way of fastening points 35 on the actuator 13, for example, by screwing, welding, clamping or other suitable force-locking, form-locking or substance-locking connections.

Quantities which were not taken into account from the beginning or which change over time, such as the manufacturing tolerances of individual components, the thermal expansion of different materials, etc. may have the result that the armature 4 no longer comes to rest completely on the pole faces 20 of the closing magnet 3 or that the charge cycle valve 1 no longer closes completely.

The further development illustrated in FIG. 4 shows the actuator 13 disposed in a floating manner and supported against a play compensating element 16. The play compensating element 16 is arranged on the side facing away from the charge cycle valve 1 between the actuator 13 and a cover 33. The play compensating element 16 absorbs tension and pressure forces and can compensate for both positive and negative play. So that the distance 25 between the driving elements 9, 10 remains identical to the spacing 24 of the path boundaries 7, 15 and therefore no play is generated, the path boundaries 7, 15 are fixedly connected with the actuator 13 or are formed by it.

It is also conceivable that the actuator 13 is fixedly disposed in the component 14 and the connection element 10 is simultaneous constructed as a play compensating element, such as a hydraulic or mechanical element. A floating bearing of the actuator 13 and additional components can be avoided.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for actuating a charge cycle valve, comprising:

an electromagnetic actuator having an opening magnet, a closing magnet, and an armature arranged between the opening and closing magnets in a coaxially displaceable manner, the armature including an armature tappet;

a valve stem acted upon by the armature tappet;

an upper driving element adaptively located so as to face away from the charge cycle valve and a lower driving element adaptively located so as to face the charge cycle valve, the upper and lower driving elements being connected for joint movement with the armature;

a spring which acts upon the valve stem, the spring being arranged between the upper driving element and the lower driving element and being displaceable between an upper path boundary and a lower path boundary, wherein the spring is supported in an open position of the charge cycle valve in an upward direction on the upper driving element and in the downward direction on the lower path boundary and, in a closed position of the charge cycle valve, the spring is supported in the upward direction on the upper path boundary and in the downward direction on the lower driving element, one driving element respectively lifts the spring off a corresponding path boundary beginning from an approximately central position of the armature between the opening magnet and the closing magnet, in which position the spring is supported at the upper and lower path boundaries; and a connection element which connects the armature tappet of the armature with the valve stem.

2. The arrangement according to claim 1, wherein the upper and lower driving elements are fastened on the armature tappet.

3. The arrangement according to claim 1, wherein the lower driving element and the connection element are constructed in one piece.

4. The arrangement according to claim 2, wherein the lower driving element and the connection element are constructed in one piece.

5. The arrangement according to claim 1, wherein the upper driving element is constructed in one piece with the armature tappet.

6. The arrangement according to claim 2, wherein the upper driving element is constructed in one piece with the armature tappet.

7. The arrangement according to claim 3, wherein the upper driving element is constructed in one piece with the armature tappet.

8. The arrangement according to claim 1, wherein the upper path boundary is fixedly connected with the actuator.

9. The arrangement according to claim 8, wherein the actuator forms the upper path boundary.

10. The arrangement according to claim 8, wherein the lower path boundary is fixedly connected with the actuator.

11. The arrangement according to claim 9, wherein the lower path boundary is fixedly connected with the actuator.

12. The arrangement according to claim 8, further comprising an external component in which the actuator is floatingly disposed; and a play compensating element which supports the actuator in the external component.

13. The arrangement according to claim 9, further comprising an external component in which the actuator is floatingly disposed; and a play compensating element which supports the actuator in the external component.

14. The arrangement according to claim 10, further comprising an external component in which the actuator is floatingly disposed; and a play compensating element which supports the actuator in the external component.

15. The arrangement according to claim 1, wherein the connection element simultaneously functions as a play compensating element.

16. The arrangement according to claim 1, wherein the spring is supported in a direction facing away from the charge cycle valve via an upper spring plate and in a direction facing the charge cycle valve via a lower spring plate, said upper and lower spring plates being displaceable coaxially to one another.

17. An arrangement for actuating a charge cycle valve, comprising:

an electromagnetic actuator having an opening magnet, a closing magnet, and an armature arranged between said opening and closing magnets, said armature having an armature tappet;

a valve stem adapted to operate the charge cycle valve;

a connection element for connecting the armature tappet and the valve stem;

upper and lower driving elements connected for joint movement with the armature; and a spring clamped between the upper and lower driving elements under prestress, wherein the upper and lower driving elements are fastened on the armature tappet.

18. The arrangement according to claim 17, wherein the upper driving element and the armature tappet are constructed as one piece.

19. The arrangement according to claim 17, wherein the lower driving element and the connection element are constructed as one piece.

* * * * *